United States Patent [19]

Wanke

[11] Patent Number: 4,516,334

[45] Date of Patent: May 14, 1985

[54] ROTARY DRYER WITH ROTARY LOW-PRESSURE SYPHON

[76] Inventor: Wilhelm Wanke, Donauschwabenstrasse 47, D-7920 Heidenheim, Fed. Rep. of Germany

[21] Appl. No.: 539,979

[22] Filed: Oct. 7, 1983

[30] Foreign Application Priority Data

Oct. 13, 1982 [DE] Fed. Rep. of Germany ..... 3237994

[51] Int. Cl.[3] ..... D06F 58/00; F26B 11/02

[52] U.S. Cl. ..... 34/124; 34/119

[58] Field of Search ..... 34/119, 124, 125

[56] References Cited

U.S. PATENT DOCUMENTS 3,640,000 2/1972 Lee et al. ..... 34/125

FOREIGN PATENT DOCUMENTS 2320519 6/1975 France ..... 34/125
889329 9/1958 United Kingdom ..... 34/125
950720 12/1962 United Kingdom ..... 34/125

*Primary Examiner*—Edward G. Favors
*Assistant Examiner*—Steven E. Warner
*Attorney, Agent, or Firm*—Walter H. Schneider

[57] ABSTRACT

A rotary dryer for the drying of a moving web of material has a thin-walled shell with lateral heads and bearing journal at each end, and is heated internally with steam. For the discharge of condensate and flash steam a low-pressure syphon rotating with the shell is provided, consisting of syphon shoe, standpipe and outlet pipe. To keep the differential pressure required for the discharge of the mix of condensate plus flash steam as low as possible even in changing operating conditions the invention provides for the arrangement of an internal baffle in the center of the syphon shoe to convey the mix of condensate in flash steam and also to stabilize it. For this purpose the internal baffle may have as supplement also additional internal subdivision chambers. Furthermore, the invention also provides for the additional arrangement of steam jet nozzles.

The rotary low-pressure syphon according to the invention (FIG. 2) is particularly effective at high production speeds for minimization of the differential pressure required for the discharge of the mix, furthermore for system stabilization in changing production conditions.

6 Claims, 4 Drawing Figures

ROTARY DRYER WITH ROTARY LOW-PRESSURE SYPHON

Figure 1:
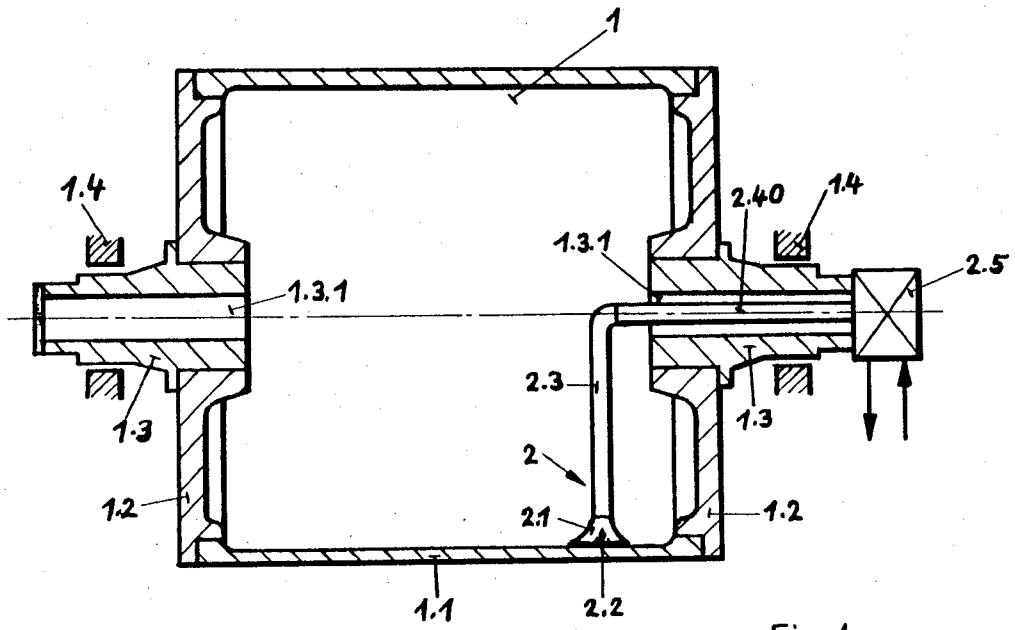

This invention relates to a rotary dryer with rotary low-pressure syphon.

As is well known, in the production of paper and board the webs of material are led through dryer sections in which water is removed from the web of material by contact drying on heated, circular dryers. These dryers are heated in the interior with condensating steam and the condensate, collecting on the inside of the dryer shell at production speeds above about 400 m/min equal to limit of condensate sump to condensate rim accumulation at the customary dryer diameters, is led away exclusively by means of syphon structures preferably through a bearing journal of the dryer. This discharge of condensate is achieved by the differential pressure between dryer interior and subsequent discharge pipe outside the dryer. The differential pressure required for this is dependent upon the specific gravity of the fluid. Usually flash steam from 10 to 30 percent by weight is used. At 15 percent by weight the specific gravity of the mix is somewhat lower than a hundredth of that of pure condensate and the above-mentioned, required differential pressure correspondingly low, provided that the condition of the mix is present and is retained at all flow points.

Low differential pressure required for maintenance of the mix discharge has the advantages that (a) of the total differential pressure available a large percentage can be used for regulation and adaptation to the respective, changing production conditions and (b) the total differential pressure required is lower, making a significant saving in energy achievable.

The said syphons installed can be subdivided into two main groups:

(a) Rotary syphons which rotate with the dryer shell, thus a great advantage being that they are firmly fixed mechanically.

(b) Stationary syphons cantilevered on a supporting structure projecting through the bearing journal the dryer, stationary in the direction of the rotating dryer shell.

The design described under (b) is virtually independent of the rotational speed of the dryer in respect of the differential pressure required for condensate removal, but does display so many serious mechanical defects due to the long, cantilevered support through the bearing journal of the dryer that no further details of this design will be given in this description. The rotary syphon described under (a) is, as regards location, a mechanically absolutely firm, well-defined unit in the dryer and thus completely suitable for heavy everyday duty in paper machines. In the said embodiments, however, it has the disadvantage technologically that a relatively high differential pressure is required to remove the condensate, which increases still further with growing rotational speed of the dryer. Thus, for example, at the customary diameters of dryers in series dryer sections, at a production speed of 1,000 m/min the part of the required differential pressure dependent on centrifugal force is about 30 percent, at 1,400 m/min, however, already close to 50 percent; these figures do, however, otherwise presuppose optimum, constant conditions. But constant conditions in running productions are not ensured by themselves owing to the large number of customary disturbance effects, which is why modifications are already well known on simple, conventional rotary syphons:

1. From U.S. Pat. No. 3,328,896 it is known that, in the area of the syphon shoe the condensate discharge is to be stabilized by channel run with several return edges, which is also achieved at low production speeds. When used for high production speeds, however, the following two main disadvantages of this design are to be mentioned:

(a) The condensate must at least be raised stably to the level "N" after the second reversing edge (in FIG. 3), wherein the differential pressure required for condensate removal, at higher speeds, calls for a multiple of the usual value owing to the distance "N" from the dryer shell.

(b) After the syphon shoe with reversing edges the mix of condensate plus flash steam is still led for long distances virtually parallel to the dryer shell, wherein, due to centrifugal force, a segregation of the two said fluids occurs. Segregated condensate, however, requires many times the differential pressure in order to be transported contrary to the effect of centrifugal force.

2. From Swedish Publication No. 770 1923-0 it is known that the mix of condensate plus flash steam instead of customary syphon types is over a long distance through bore(s) in the dryer shell. The following disadvantages occur:

(a) Due to centrifugal force, a segregation of condensate and flash steam occurs in this/these bore(s), with the same disadvantageous pressure-increasing effect as already stated under 1(b).

Figure 2:
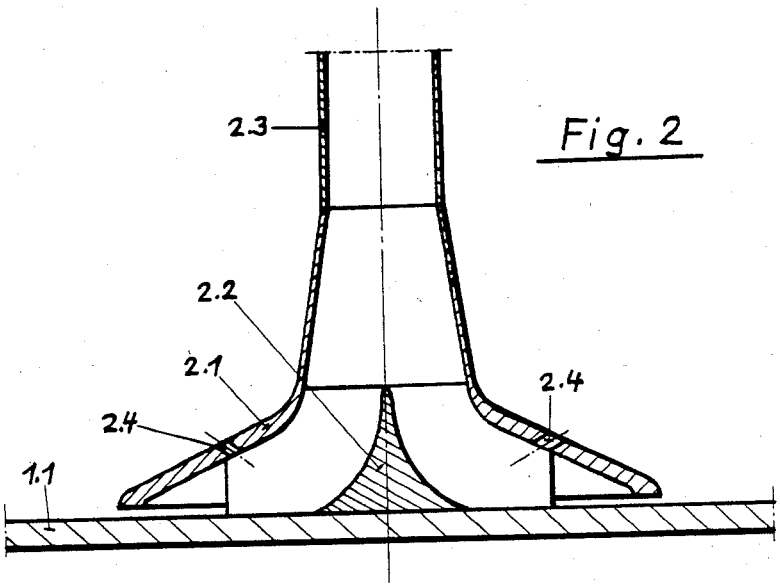

(b) The present invention furthermore provides for limiting the rate of the flash steam by a throttle, as shown in FIG. 2. If the limiting effect of this throttle were fully effective, that is, accordingly, almost only condensate alone were to be transported contrary to the direction of centrifugal force, because of the specific gravity of condensate at, for example, 1,000 m/min, a differential pressure very much much higher than that of the total steam pressure fed to the paper machine would be required.

3. In the English Patent Specification No. 956,588 it is indicated for the special needs of a dryer with internal grooves in the dryer shell the mix of condensate and flash steam is to be collected in tubes nestling against the circumference of the dryer shell and then discharged in the direction of dryer centre. Here, there likewise occurs a segregation, due to centrifugal force, of condensate and flash steam, with the same disadvantageous pressure-increasing effect as described under 1(b).

4. From the German Patent Specification No. 1 137 938 a syphon design is known which in form comes nearest to the present invention. This design is conceived for lower speeds, hence the condensate collecting chamber 17. Otherwise the idea of steam jet orifices 16*e* and 16*f* for the generation of a chimney effect can also be transferred to high speeds in order to ensure a flow in the direction of the dryer center even when excess quantity occurs intermittently. But no precautions have been taken to reduce the large share of the differential pressure for overcoming the centrifugal force, which occurs at high speeds. On the contrary, due to the shape of the limiting plate 18 of the condensate collecting chamber 17, a disadvantageously high accumulation of condensate would form at high speeds in the corner between limiting plate 18 and the shell of the dryer, which in turn would multiply the differential pressure required for conveyance against the effect of the centrifugal force. The conventional, rotary syphon contains no structures whatsoever inside the syphon shoe, through which a condensate cone forms in the center of the syphon shoe, which with increasing height greatly increases the differential pressure required for conveyance against the effect of centrifugal force.

It is the object of the present invention to arrange a rotating dryer with rotary low-pressure syphon in the interior of the dryer, with which, even at high production speeds, (a) the differential pressure required for discharge of the mix of condensate plus flash steam is kept as low as possible, (b) a disadvantageous, subsequent segregation of flash steam and condensate is effectively counteracted, (c) even upon flooding due to a brief excess quantity of condensate a compound flow in the direction of the center of dryer is ensured; and this with continued low differential pressure required.

This object is solved by the arrangement of an internal baffle in the center of the syphon shoe on the inside of the shell of the dryer which, due to location and shape, conveys the mix of condensate in flash steam in order to have only a mix on the way against the effect of centrifugal force, which very substantially contributes to minimizing the differential pressure required.

This securing of the mix formation ahead of the stretch directed against the centrifugal force is, as per invention, furthermore additionally assisted by the fact that steam jet nozzles one or more, are so arranged in the syphon shoe that the flash steam flowing through said steam jet nozzles is directed towards the impact areas of the internal baffle. In this way the mixture of condensate still arriving at the edge of the internal baffle on the inside of the shell of the dryer is achieved, this condensate not yet mixed or else, already due to centrifugal force, again partially segregated, intensified with flash steam, which ensures mix formation even in operating conditions with flooding of the outer edge of the syphon shoe due to a brief excess quantity of condensate. Furthermore, in addition the stabilization of the chimney effect known from the German Patent Specification No. 1 137 938 is then retained, but with the difference: without any risk of an increase in the differential pressure required.

As already stated at the beginning of this description, the rotary dryers in paper and board machines are heated internally with condensating steam. At high production speeds the condensate created by the condensing steam forms, on the inside of the shell of the rotary dryer, a film of fluid rotating with the shell covering the entire inner surface of the shell. Condensate is to be continuously removed from this film of fluid and discharged from the rotary dryer, mechanically conditioned, through one or both bearing journals and subsequent fitting. To keep the heat transfer to the outside of the shell of the dryer as large as possible, the film of condensate fluid must be as thin as practically achievable, with a thickness usually less than 1.5 mm so that the condensate fluid does not act as a disturbing insulating layer. Such low thicknesses of the film of condensate fluid can be achieved with relatively simple mechanical and, in addition absolutely reliable, resistant means only by the use of syphons rotating along with the shell of the dryer.

This type of syphon is characterized by the fact that a syphon shoe is arranged on the inside of the shell and from this a standpipe then leads to the bearing journal of the dryer. The standpipe is directly followed by the outlet pipe through the bearing journal out of the interior of the dryer to a fitting; here, the bore, passing right through the bearing journal, can be part of the outlet pipe.

The conveyance of the condensate out of the dryer begins in that condensate flows towards the syphon shoe out of the film of condensate fluid on the inside of the shell of the dryer. The siphon shoe has, at the outer edge opposite the shell of the dryer, a narrow inlet point which (a) limits the quantity of the flash steam to a reasonable extent and (b) initiates the mixture of flash steam and condensate, this beginning already shortly ahead of this inlet point. At the latest in the geometric center of the syphon shoe the mix of condensate plus flash steam must be conveyed against the effect of centrifugal force in the direction of the center of the dryer. From the area where the mixture of flash steam and condensate is initiated up to the geometric center of the syphon shoe the direction of flow is totally or virtually parallel to the shell of the rotary dryer. In this area, due to the mixing process, another segregation due to the separating effect of the centrifugal force is immediately initiated, with the result that a part of the condensate has again segregated up to the geometric center of the syphon shoe and rests on the inside of the shell of the rotary dryer in the form of fluid. Because of its high specific gravity, the segregated part of the condensate requires a very large differential pressure to discharge out of the dryer.

The rotary low-pressure syphon due to invention is characterized by the fact that in the area of the geometric center of the syphon shoe an internal baffle is arranged which, due to its shape, brings about a mixture of condensate arriving in this area with flash steam. In the embodiment of the invention this is achieved by the fact that, viewed in the direction of flow, the internal baffle at the transition from shell of the dryer has an impact area in whose zone the above-mentioned mixture of condensate and flash steam is created by a controlled turbulence. In the invention the angle a of the internal baffle is smaller than 90 degrees in the impact area to avoid disadvantageous backflows contrary to the direction of conveyance. After the impact area the contour of the internal baffle is designed so that in the reversal area the mix is deflected along the shortest possible path in the direction of flow of the standpipe in order to be able to avoid a repeated separator effect of the centrifugal force fully through rapid achievement of this direction of flow. In order to further ensure the said repeat mixture of condensate with flash steam, the invention also provides for subdividing the customary full 360 degrees round syphon shoe into internal subdivided chambers so that in the area of the internal baffle secondary flows are prevented as far as possible to entirely without subdivision, due, for example, to 0-degree flow to 180-degree flow. The invention also provides for arranging at least one steam jet nozzle per subdivision chamber in such a way that the flash steam flowing through said steam jet nozzle, inclined at an angle of flow b smaller than 90 degrees relative to the shell of the dryer tends to occur in the impact area of the internal baffle.

This also makes a contribution to stabilizing the remixture of condensate with flash steam, even when there is a brief excess quantity of condensate. Furthermore, the arrangement of the steam jet nozzle at this point and with the said angle of flow b smaller than 90 degrees ensures that as far as possible no secondary flow against the direction of conveyance can occur.

These said details of the invention result in a continuous delivery flow of medium in solely mix condition in the direction of the center of the rotary dryer. Due to this securing of the mix condition it is also ensured, due to the low specific gravity in the mix, that the differential pressure required for the conveying process at the rotary low-pressure syphon is also almost as low at high production speeds as on the stationary type of syphon. The rotary low-pressure syphon can, however, be so fixed mechanically, as a very substantial advantage compared to the stationary syphon, that it fully copes with the rough operating conditions in the operation of paper and board machines. This mechanical advantage is, in the embodiment of the invention in the design of the rotary low-pressure syphon, combined with minimum differential pressure required. The latter in turn permits the saving of energy and/or extends the range of the share of pressure required for the control of the various operating requirements on the total pressure range.

Exemplified embodiments of the rotary low-pressure syphon according to the invention also in the rotary dryer are shown in the drawings.

FIG. 1 shows a cross section through a rotary dryer 1 with rotary low-pressure syphon 2 according to the invention, which is mechanically arranged stationary on the inside of the shell 1.1 of the rotary dryer 1. The rotary dryer 1 consists of the main elements: shell 1.1, two end heads 1.2 and two bearing journals 1.3, the latter with bearing locations 1.4. At least one bearing journal 1.3 has a through-going bore 1.3.1 through which the live steam can enter and the mix of condensate plus flash steam can flow out. The rotary low-pressure syphon 2 consists of the main elements: syphon shoe 2.1 with internal baffle 2.2, subsequent standpipe 2.3, outlet pipe 2.40 and fitting 2.5. Outlet pipe 2.40 and through-going bore 1.3.1 in the bearing journal 1.3 can be combined as desired in the function limitation, due to the mechanical design, or partly integrated in variations which are already well known.

FIG. 2 shows a cross section in the area of the syphon shoe 2.1 of the low-pressure syphon 2 according to the invention. This shows: part of the shell 1.1 of the rotary dryer 1 and syphon shoe 2.1 with internal baffle 2.2 and steam jet nozzles 2.4 as well as part of the standpipe 2.3.

Figure 3:
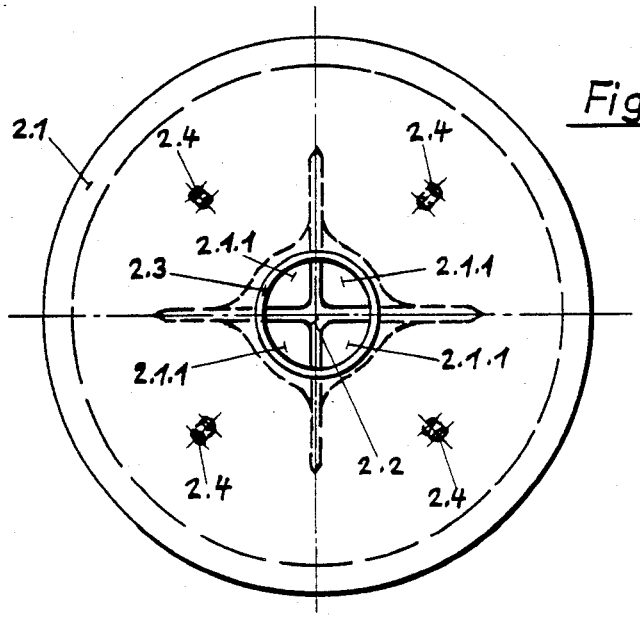

FIG. 3 shows a plan view relating to FIG. 2, viewed from the stand pipe. This shows: standpipe 2.3, syphon shoe 2.1 with internal subdivision chambers 2.1.1, internal baffle 2.2 and steam jet nozzles 2.4.

Figure 4:
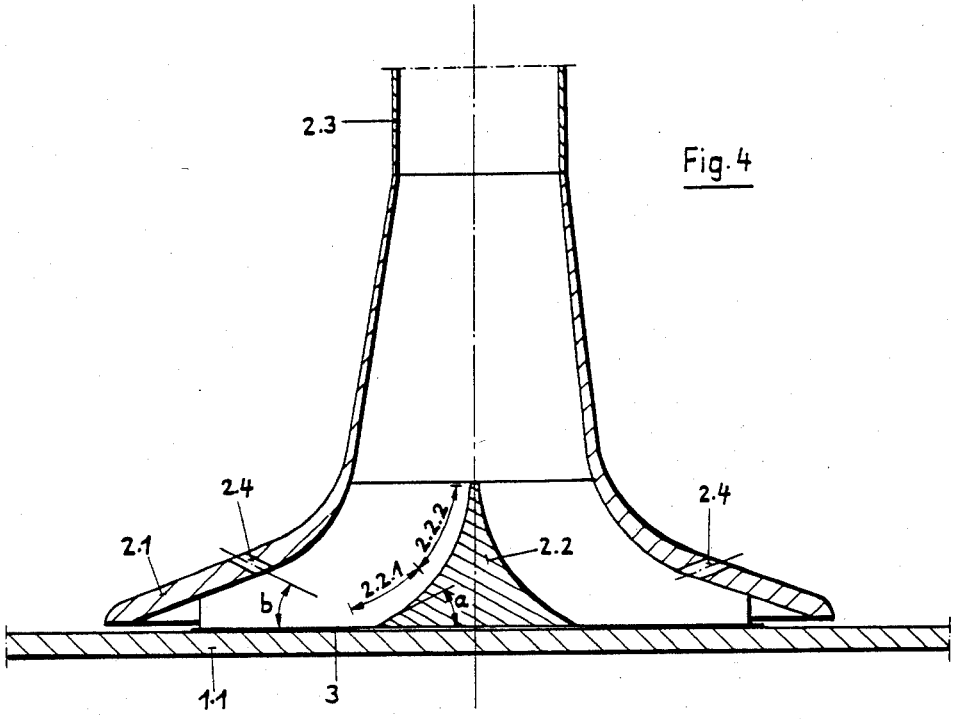

FIG. 4 shows an example of the design in the area of the baffle 2.2 according to the invention. The angle a in the impact area 2.2.1, at the beginning of the internal baffle 2.2, has according to the invention been so selected that within a distance of 3 to 100 mm from the beginning of the internal baffle there results a value greater than 5 degrees, but smaller than 85 degrees for the angle a. Furthermore, after this distance the internal baffle 2.2 exhibits such a shape, identical to reversing area 2.2.2, that, deviating from the theoretically ideal arc flow contour, the internal baffle 2.2 reverses very rapidly in the direction of the symmetrical line of the standpipe 2.3. Furthermore, FIG. 4 shows a steam jet nozzle 2.4, through the wall of the syphon shoe 2.1, whose direction of flow at the flow angle b is directed to the area of the impact zone 2.2.1 of the internal 2.2. Furthermore, the possibility is shown of preceding the internal baffle 2.2 with a wear protecting plate 3 in the direction of flow, in shape parallel or nearly parallel to the shell 1.1 of the rotary dryer 1, and resting protectively on the shell 1.1 in order to protect the shell mechanically.

It will be understood that while the scope of this invention has been described in connection with a dryer cylinder for a paper machine dryer, it may be used to equal advantage in dryer cylinders for machines making other things than paper, and that the construction thereof may be modified to suit a particular technical application without departing from the basic principles of the invention. Hence, it is intended to cover all forms of the invention coming within the scope of the appended claims.

What is claimed is:

1. In a steam heated dryer drum adapted to rotate in two opposed bearing journals at its axis and provided with means for introducing steam into the interior thereof through one of said bearing journals and further provided with syphon means rotatable with said drum for removing condensate from the interior thereof through either of said bearing journals, said syphon means comprising an outlet pipe extending through said journal bearing communicating with a standpipe provided with a syphon shoe at its end adjacent the interior surface of said drum the chamber of which receives condensate therefrom and directs said condensate from its edge toward its center along a flow path essentially parallel to said drum surface; a baffle within said syphon shoe chamber adapted to change the essentially parallel flow of said condensate so as to direct said flow into said standpipe; and at least one steam jet nozzle in the wall of said syphon shoe for introducing steam into said chamber in a direction toward said baffle at an angle to the surface of said drum of less than 90°.

2. A steam heated dryer drum according to claim 1 in which said baffle has generally the contour of a cone with its base adjacent the interior surface of said drum and its wall curving inwardly away therefrom to an apex, said baffle having an axis common with that of said standpipe.

3. A steam heated dryer drum according to claim 2 in which the curve of said cone wall is such that the angle between the base of said cone and a line drawn tangent to said wall at any point from 3–100 mm from the edge of said base varies from 5° to 85°.

4. A steam heated dryer drum according to claim 3 in which said baffle divides said syphon shoe chamber into a plurality of sub-chambers each of which is provided with a steam jet in its wall.

5. A steam heated dryer drum according to claim 4 in which there are four equal sub-chambers.

6. A steam heated dryer drum, according to claim 4 in which said syphon shoe is provided with a wear protecting plate essentially parallel to and resting on the surface of said drum.

* * * * *